US007665814B2

(12) United States Patent
Laible

(10) Patent No.: US 7,665,814 B2
(45) Date of Patent: Feb. 23, 2010

(54) COLD GOODS CONTAINER FOR A COOLING APPARATUS

(75) Inventor: Karl-Friedrich Laible, Langenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 859 days.

(21) Appl. No.: 10/725,088

(22) Filed: Dec. 1, 2003

(65) Prior Publication Data

US 2004/0164654 A1 Aug. 26, 2004

Related U.S. Application Data

(63) Continuation of application No. PCT/EP02/05863, filed on May 28, 2002.

(30) Foreign Application Priority Data

Jun. 1, 2001 (DE) ..... 101 26 841

(51) Int. Cl.
*A47B 96/04* (2006.01)

(52) U.S. Cl. ..... 312/408; 312/331

(58) Field of Classification Search ..... 312/404, 312/402, 408, 331, 116, 334.18, 334.19, 312/334.7; 62/382

See application file for complete search history.

(56) References Cited

U.S. PATENT DOCUMENTS

| | | | | |
|---|---|---|---|---|
| 1,837,293 | A | 12/1931 | Sanford | |
| 2,801,146 | A * | 7/1957 | Mikulas | 312/301 |
| 3,006,710 | A | 10/1961 | Petkwitz | |
| 3,456,996 | A | 7/1969 | Heiniger-Schar | |
| 4,863,288 | A | 9/1989 | Houck | |
| 5,025,545 | A | 6/1991 | Brown | |
| 5,040,856 | A * | 8/1991 | Wilkins et al. | 312/402 |
| 5,366,284 | A | 11/1994 | Baker et al. | |
| 6,641,239 | B2 * | 11/2003 | Kaiser | 312/404 |

FOREIGN PATENT DOCUMENTS

| | | |
|---|---|---|
| DE | 30 03 818 A1 | 8/1981 |
| DE | 297 17 743 U1 | 2/1999 |

* cited by examiner

*Primary Examiner*—Hanh V Tran
(74) *Attorney, Agent, or Firm*—James E. Howard; Andre Pallaples

(57) ABSTRACT

A guide assembly for a refrigerated-goods container of a refrigeration device is provided. The guide assembly includes a pair of guide rails for a drawer and the guide rails are mountable on walls of a refrigerated-goods container. The guide rails are mountable on the walls by a compensatory element at an acute angle to the respective wall. The angle is defined such that the rails of the pair run parallel to one another.

16 Claims, 3 Drawing Sheets

COLD GOODS CONTAINER FOR A COOLING APPARATUS

CROSS-REFERENCE TO RELATED APPLICATION

This application is a continuation of copending International Application No. PCT/EP02/05863, filed May 28, 2002, which designated the United States and was not published in English.

BACKGROUND OF THE INVENTION

Field of the Invention

The invention relates to a cold goods container for a cooling apparatus and a cooling apparatus that is equipped with such a container.

Cold goods containers, particularly for household cooling apparatuses like refrigerators and freezers, are frequently produced in one piece from plastic flat material by molding. To guarantee good deformability of the container, the opposing walls of the container must be given a deformation angle, i.e., the walls do not extend exactly parallel but rather include a slight divergence in the direction of the open front side of the cold goods container. The non-parallel disposition of the sidewalls leads to problems when pullout shelves are constructed in such a cold goods container. Specifically, guide rails that are mounted on the sidewalls would have to allow movement of a pullout shelf that is guided on the rails not only in the longitudinal direction of the rails but also to a smaller degree transverse thereto. The play that is required therefor conflicts with the precise and smooth guidance of the rails.

To prevent such a problem from occurring, in conventional cooling apparatuses, the sidewalls of the cold goods container are provided with what is referred to as a 0° deformation angle in regions in which a pullout shelf is to be mounted. That is, the sidewalls extend exactly parallel to one another in this region.

But the production of exactly parallel sidewalls is associated with a substantial additional outlay in the molding process. Whereas a cold goods container with a molding bevel on all sides can be produced with the aid of simply constructed dies that move back and forth only in a main direction, the production of sidewalls that are parallel to this main direction requires multipart dies with slides that are movable in a direction other than the main direction.

SUMMARY OF THE INVENTION

It is accordingly an object of the invention to provide a cold goods container for a cooling apparatus that overcomes the hereinafore-mentioned disadvantages of the heretofore-known devices of this general type and that can be produced with simple and inexpensive dies and that, nevertheless, allows exact guidance of a pullout shelf in the cold goods container.

With the foregoing and other objects in view, in a cold goods container for a cooling apparatus having an open front side, at least one pullout shelf, and sidewalls diverging in a direction of the front side, there is provided, in accordance with the invention, a guide assembly including a compensating element, at least one pair of guide rails guiding the pullout shelf at least partway out of the cold goods container through the open front side, and the compensating element mounting at least one guide rail of each of the pair of guide rails at one of the sidewalls at an acute angle to the sidewall, the angle being defined to extend the rails of the pair of guide rails parallel to one another.

According to the invention, at least one of two guide rails of a rail pair that is needed for guiding a cold goods container is mounted on one of the sidewalls by way of a compensating element at an acute angle to the sidewall, which angle compensates the divergence of the sidewalls and is defined such that the rails of the pair extend in parallel fashion. The two rails of a pair, advantageously, include mirror-symmetrical compensating elements so that each compensating element cancels out half the divergence angle.

In accordance with another feature of the invention, the compensating element is integral with the guide rail.

In accordance with an added feature of the invention, the compensating element is formed advantageously in one piece at the rail. Such a configuration only requires a small extra expenditure in the rail production process, and the assembly of the rails at a sidewall can be accomplished in the manner that is customary for walls having 0° molding bevels.

In accordance with a further feature of the invention, the compensating element can have the shape of a wedge that extends substantially over the whole length of the rail, but it is also imaginable to construct it as a local projection in the vicinity of one end of the rail.

In accordance with an additional feature of the invention, the rail can have a C-shaped cross-section with a top leg and a bottom leg and a center-piece connecting the legs. Such a rail shape is particularly suitable for roller guidance. In that case, the compensating element is formed advantageously in the center piece by stamping.

In accordance with yet another feature of the invention, the compensating element has a contact surface adjoining the sidewall and the guide rail carries, on the contact surface of the compensating element, at least one hook protruding through an opening of the sidewall.

In accordance with yet a further feature of the invention, the guide rail has at least one hook protruding through an opening of the sidewall.

In accordance with yet an added feature of the invention, the sidewalls have ribs and the at least one pair of guide rails are mounted in a region of the sidewalls without the ribs.

With the objects of the invention in view, in a cold goods container for a cooling apparatus having an open front side, at least one pullout shelf, and sidewalls diverging in a direction of the front side, there is also provided a guide assembly including at least one pair of guide rails guiding the pullout shelf at least partway out of the cold goods container through the open front side, the at least one pair of guide rails having an integral compensating element mounting at least one guide rail of the pair of guide rails at one of the sidewalls at an acute angle to the sidewall, the angle being defined to extend the rails of the pair of guide rails parallel to one another.

With the objects of the invention in view, in a cold goods container for a cooling apparatus having an open front side, at least one pullout shelf, and sidewalls diverging in a direction of the front side, there is also provided a guide assembly including at least one pair of guide rails guiding the pullout shelf at least partway out of the cold goods container through the open front side, the at least one pair of guide rails having an integral compensating element mounting at least one guide rail of the pair of guide rails at one of the sidewalls at an acute angle to the sidewall, the angle being defined to extend the rails of the pair of guide rails parallel to one another and a C-shaped cross-section with a top leg, a bottom leg, and a center piece joining the top and bottom legs, the compensating element being formed at the center piece.

With the objects of the invention in view, in a cold goods container for a cooling apparatus having an open front side, at least one pullout shelf, and sidewalls diverging in a direction of the front side, there is also provided a guide assembly including at least one pair of guide rails guiding the pullout shelf at least partway out of the cold goods container through the open front side, the at least one pair of guide rails having an integral compensating element mounting at least one guide rail of the pair of guide rails at one of the sidewalls at an acute angle to the sidewall, the angle being defined to extend the rails of the pair of guide rails parallel to one another and at least one hook protruding through an opening of the sidewall.

With the objects of the invention in view, there is also provided a cooling apparatus, including at least one cold goods container having an open front side, at least one pullout shelf, sidewalls diverging in a direction of the front side, and a guide assembly having a compensating element, at least one pair of guide rails guiding the pullout shelf at least partway out of the cold goods container through the front side, and the compensating element mounting at least one guide rail of each of the pair of guide rails at one of the sidewalls at an acute angle to the sidewall, the angle being defined to extend the rails of the pair of guide rails parallel to one another.

Other features that are considered as characteristic for the invention are set forth in the appended claims.

Although the invention is illustrated and described herein as embodied in a cold goods container for a cooling apparatus, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
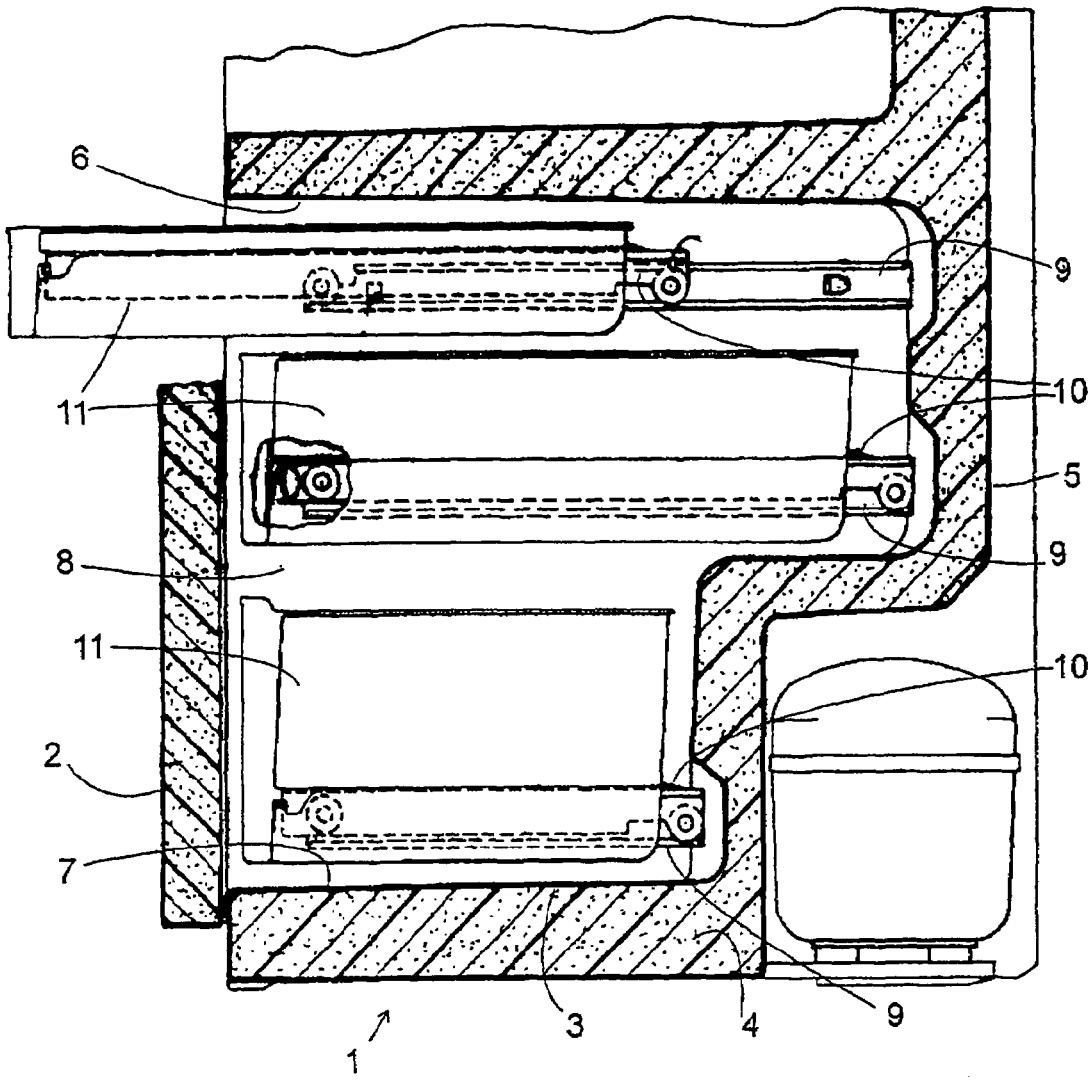
FIG. 1 is a fragmentary, cross-section of a cooling apparatus according to the invention.

Referring now to the figures of the drawings in detail and first, particularly to FIG. 1 thereof, there is shown a section of a bottom region of a cooling apparatus, possibly a freezer compartment or crisper of a combination cooling apparatus. The cooling apparatus includes a thermally insulating housing 1 with an open front side that is sealable with a door 2. The housing 1 is composed of a cold goods container 3 that is drawn from plastic in one piece, which forms the inner wall of the cooling space, a thermally insulating layer 4 of foam material, and an outer shell 5 of sheet metal. Based on the production technique for producing the cold goods container 3, its wall surfaces, i.e., cap 6 and floor 7, and the sidewalls 8, respectively, are slightly divergent, by an angle of 1 to 2°, relative to the front side of the housing or the door 2, as the case may be.

In such an example, three sets of guide rails 9 are mounted on the sidewalls 8 opposite one another at different heights and interact with complementary guided rails 10 that are mounted at pullout shelf bins 11 so that these bins 11 can easily be pulled out of and pushed into the cold goods container 3. The sidewalls 8 are without ribs, which allows the assembly of the guide rails 9 on the sidewall at arbitrary heights. A single model of cold goods container can, thus, be utilized in a number of cooling apparatus models that include a different partitioning of compartments and different numbers and sizes of pullout shelves.

Figure 4:
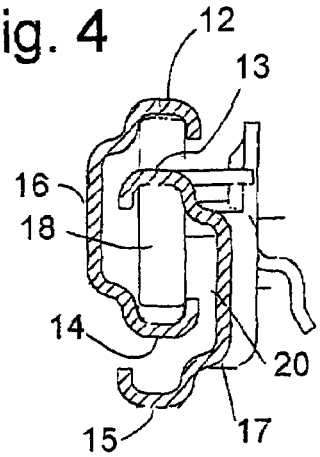
FIG. 4 is a cross-sectional view through the guide rail and the guided rail along section line IV-IV in FIG. 3.
Figure 5:
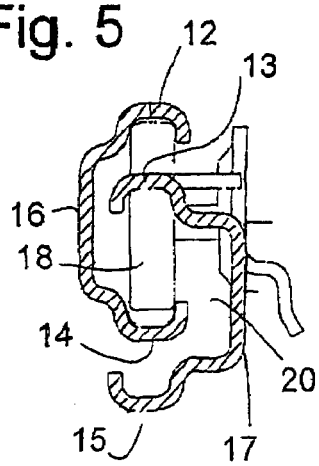
FIG. 5 is a cross-sectional view through the guide rail and the guided rail along section line V-V in FIG. 3.
Figure 2:
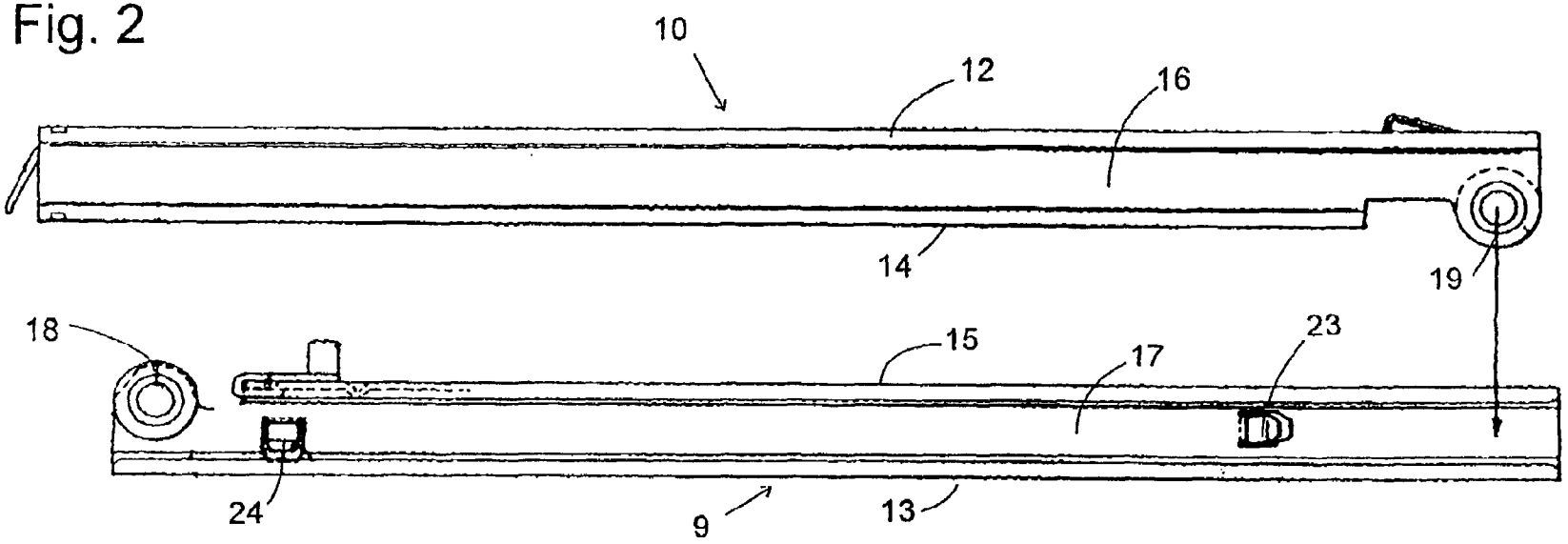
FIG. 2 is a side elevational exploded view of a guide rail to be mounted on a sidewall of the cold goods container of the cooling apparatus from FIG. 1, and a complementary guided rail to be mounted at a pullout shelf from FIG. 1.
Figure 3:
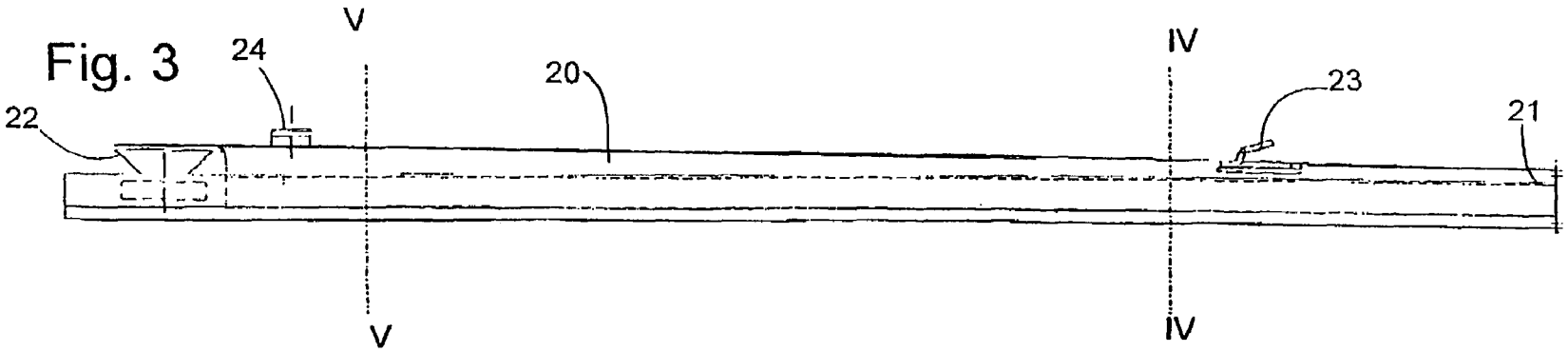
FIG. 3 is a plan and partially hidden view of the guide rail and guided rail of FIG. 2 in a joined condition.

A guide rail 9 and the rail 10, which is allocated to it, of the pullout shelf bin 11 are represented in FIG. 2 separately in side views, in FIG. 3 in a plan view in the joined condition, and in FIGS. 4, 5 in the sections along the lines IV-IV and V-V from FIG. 3, respectively.

The two rails 9, 10 are elongated profile parts of metal with a substantially C-shaped cross-section with a top leg 12, 13, a bottom leg 14, 15, and a center piece 16, 17 connecting the legs. The center piece 17 of the guide rail 9 bears a roller 18 at its end facing the door 2, which roller 18 braces the top leg 12 of the guided rail 10 in the joined condition; on the end of its center piece 16 that is averted from the door 2, the guided rail 10 bears a roller 19, which braces either on the bottom leg 15 or under the top leg 13, depending on how far out the pullout bin 11 at which the rail 10 is mounted has been pulled. A U-shaped channel 20 is formed in the center piece 17 of the guide rail 9, whose depth increases from the end 21 farther from the door to the end 22 nearer the door, as represented in the two sections 4 and 5. This channel 20 forms a compensating element whose depth increasing over the length of the guide rail 9 compensates the divergence of the sidewalls 8 of the cold goods container 3 and guarantees an exactly parallel orientation of the legs 13, 15 of two opposing guide rails 9 that are allocated to the same pullout shelf.

Two hooks, a horizontal hook 23 and a vertical hook 24, are punched in the center piece 17 at the bottom of the channel 20. With the aid of these hooks, the guide rail 9 can be anchored directly in the openings (not illustrated) of the sidewall 8 of the cold goods container 3, without any additional connecting parts being required. With the installation of these openings at different heights of the sidewall, a cold goods container 3 can be easily adapted to its utilization in different cooling apparatus models that differ in the number, configuration, and size of the pullout shelves.

Figure 6:
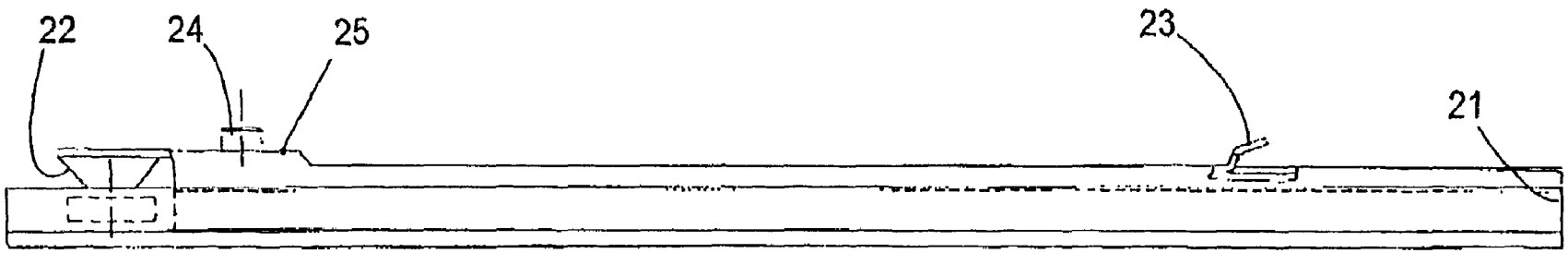
FIG. 6 is a plan and partially hidden view of a guide rail and a guided rail according to a second embodiment of the invention.

FIG. 6 is a plan view representing a configuration of guide rails and guided rails according to a second development of the invention. The guided rail 10 is identical to the one in FIG. 2 and the cross-sections along lines IV-IV and V-V are also the same as in the above-described development. The difference lies in the fact that, in FIG. 6, the compensating element is not formed by a channel with a progressively larger depth from one end of the guide rail to the other, rather, the depth of the channel 20 remains the same for the greater part of the length of the guide rails 9 as in FIG. 4. Instead, a local projection 25 is formed solely in the region of the end 22 near the door, whose exterior surface, which faces the sidewall 8 and bears the vertical fastening hooks 24, is a greater distance from the legs 13, 15 of the guide rail 9 that guide the rollers 19 of the guided rail 10 than is the exterior surface in the environment of the horizontal hook 23.

Of course, there are a number of other possible embodiments of the present invention besides the two described here. The compensating element need not be of one piece with the guide rail like the channel 20 or the projection 25; rather, a compensating element that is fastened to the guide rail can also be employed that lies between the guide rail and sidewall after assembly. This kind of compensating element could also be inserted afterward between the temporarily mounted guide rail and the sidewall in the region of the hook 24 nearer the door so as to clamp the sidewall in place between the hook 24, which extends in through an opening of the wall, and the compensating element.

I claim:

1. A guide assembly comprising:

a compensating element;

at least one pair of guide rails, each of the guide rails being mountable on a respective sidewall of a cold goods container of a cooling apparatus and the pair of guide rails being operable to guide a pullout shelf of a cold goods container such that the pullout shelf is configured to be guided by the pair of guide rails at least partway out of the cold goods container through an open front side of the cold goods container; and said compensating element being configured to mount at least one guide rail of each of said pair of guide rails at one of the sidewalls at an acute angle to the sidewall, said angle being defined to extend said rails of said pair of guide rails parallel to one another.

2. The guide assembly according to claim 1, wherein:

said compensating element is a plurality of compensating elements;

each of said guide rails has one of said compensating elements; and said compensating elements of said guide rails of said pair of guide rails are mirror-symmetrical.

3. The guide assembly according to claim 1, wherein said compensating element is formed at said guide rail in one piece.

4. The guide assembly according to claim 1, wherein said compensating element is integral with said guide rail.

5. The guide assembly according to claim 1, wherein said compensating element is wedge shaped and extends substantially over an entire length of said guide rail.

6. The guide assembly according to claim 1, wherein:

said guide rail has an end facing the front side; and said compensating element is a local projection of said guide rail in a region of said end.

7. The guide assembly according to claim 3, wherein:

said guide rail has an end facing the front side; and said compensating element is a local projection of said guide rail in a region of said end.

8. The guide assembly according to claim 4, wherein:

said guide rail has an end facing the front side; and said compensating element is a local projection of said guide rail in a region of said end.

9. The guide assembly according to claim 1, wherein:

said guide rail has a C-shaped cross-section with a top leg, a bottom leg, and a center piece joining said top and bottom legs; and said compensating element is formed in said center piece.

10. The guide assembly according to claim 3, wherein:

said guide rail has a C-shaped cross-section with a top leg, a bottom leg, and a center piece joining said top and bottom legs; and said compensating element is formed in said center piece.

11. The guide assembly according to claim 4, wherein:

said guide rail has a C-shaped cross-section with a top leg, a bottom leg, and a center piece joining said top and bottom legs; and said compensating element is formed in said center piece.

12. The guide assembly according to claim 1, wherein:

said compensating element has a contact surface; and said guide rail carries, on said contact surface of said compensating element, at least one hook.

13. The guide assembly according to claim 1, wherein said guide rail has at least one hook.

14. A cooling apparatus, comprising:

at least one cold goods container having:

an open front side;

at least one pullout shelf;

sidewalls diverging in a direction of said front side; and a guide assembly having:

a compensating element;

at least one pair of guide rails guiding said pullout shelf at least partway out of said cold goods container through said front side; and said compensating element mounting at least one guide rail of each of said pair of guide rails at one of said sidewalls at an acute angle to said sidewall, said angle being defined to extend said rails of said pair of guide rails parallel to one another.

15. The guide assembly according to claim 1 and further comprising a C-shaped cross-section with a top leg, a bottom leg, and a center piece joining said top and bottom legs, said compensating element being formed at said center piece.

16. The guide assembly according to claim 2 and further comprising at least one hook protruding through an opening of a sidewall of a cold goods container for a cooling apparatus.

* * * * *

UNITED STATES PATENT AND TRADEMARK OFFICE

CERTIFICATE OF CORRECTION

PATENT NO. : 7,665,814 B2
APPLICATION NO. : 10/725088
DATED : February 23, 2010
INVENTOR(S) : Karl-Friedrich Laible It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1527 days.

Signed and Sealed this

Seventh Day of December, 2010

David J. Kappos

David J. Kappos
*Director of the United States Patent and Trademark Office*